US007726273B2

(12) United States Patent
Azevedo et al.

(10) Patent No.: US 7,726,273 B2
(45) Date of Patent: Jun. 1, 2010

(54) HIGH STRENGTH STEEL CYLINDER LINER FOR DIESEL ENGINE

(75) Inventors: Miguel Azevedo, Ann Arbor, MI (US); Eric Highum, Howell, MI (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 51 days.

(21) Appl. No.: 11/079,032

(22) Filed: Mar. 14, 2005

(65) Prior Publication Data

US 2005/0199196 A1 Sep. 15, 2005

Related U.S. Application Data

(60) Provisional application No. 60/553,265, filed on Mar. 15, 2004.

(51) Int. Cl.
*F02F 1/00* (2006.01)

(52) U.S. Cl. ..... 123/193.2

(58) Field of Classification Search ..... 123/193.2, 123/193.3; 29/888.061
See application file for complete search history.

(56) References Cited

U.S. PATENT DOCUMENTS

| | | | | |
|---|---|---|---|---|
| 1,781,207 | A | 11/1930 | Wysong | |
| 3,095,204 | A | 6/1963 | Neely | |
| 3,617,349 | A | 11/1971 | Prasse | |
| 3,643,637 | A * | 2/1972 | Strossner et al. | 123/41.72 |
| 3,715,790 | A | 2/1973 | Reinberger | |
| 3,814,447 | A | 6/1974 | Prasse et al. | |
| 3,914,574 | A | 10/1975 | Hill et al. | |
| 4,334,927 | A | 6/1982 | Hyde et al. | |
| 4,420,543 | A | 12/1983 | Kondo et al. | |
| 4,570,946 | A | 2/1986 | Tsuchiya et al. | |
| 4,706,417 | A | 11/1987 | Gary | |
| 4,899,702 | A | 2/1990 | Sasaki et al. | |
| 4,921,734 | A | 5/1990 | Thorpe et al. | |
| 5,148,780 | A * | 9/1992 | Urano et al. | 123/193.2 |
| 5,303,682 | A | 4/1994 | Donahue et al. | |
| 5,443,920 | A | 8/1995 | Fujisawa et al. | |
| 5,601,293 | A | 2/1997 | Fukutome et al. | |
| 5,676,096 | A * | 10/1997 | Nishi et al. | 123/41.83 |

(Continued)

FOREIGN PATENT DOCUMENTS

DE 4323702 1/1995

(Continued)

OTHER PUBLICATIONS

Hommelwerke, Surface Texture Analysis The Handbook, 3 pages total (cover, 14/15, 28.

(Continued)

*Primary Examiner*—M. McMahon
(74) *Attorney, Agent, or Firm*—Robert L. Stearns; Dickinson Wright, PLLC

(57) ABSTRACT

A diesel engine is fitted with a thin-walled wet liner fabricated of steel. The liner has a hardness that is within 10-20 Rc of the hardness of the piston rings carried on a piston within the liner. The inner surface of the liner is manufactured with a TRD=5Rvk (100–M,2) of between 30 and 400 μm, and a compound liner thickness to bore diameter in the range of 1.5 to 4 percent.

9 Claims, 1 Drawing Sheet

Figure 1:
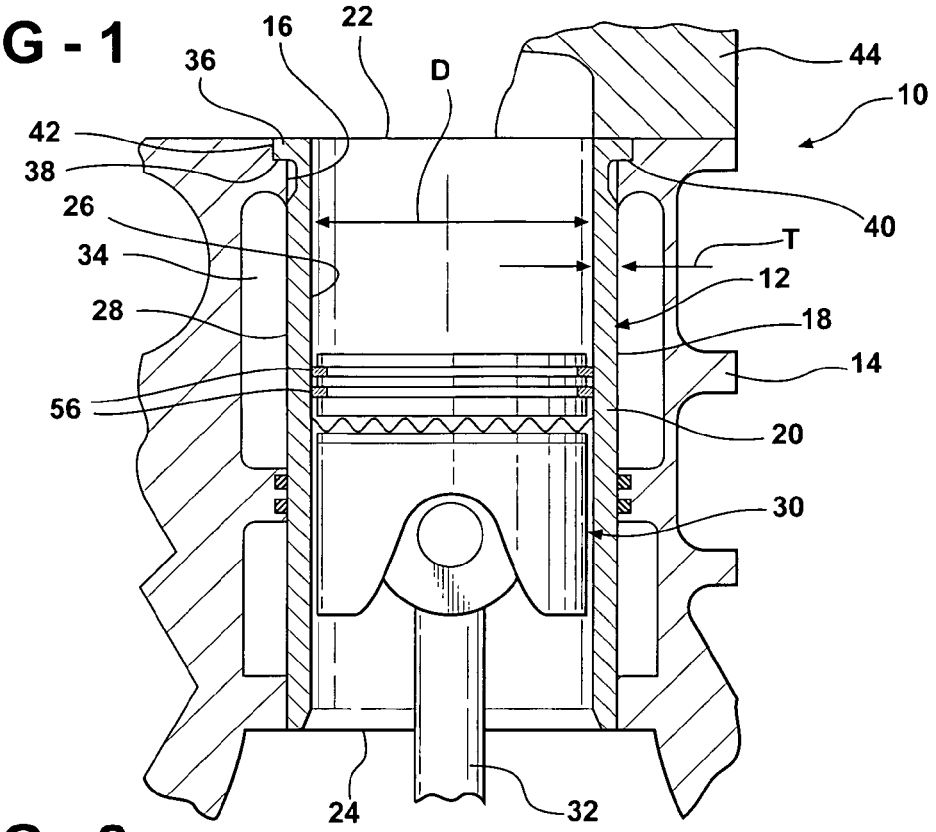

U.S. PATENT DOCUMENTS 5,829,405 A * 11/1998 Godel ..... 123/193.2
5,851,659 A 12/1998 Komuro et al.
5,887,558 A * 3/1999 Kampichler et al. ..... 123/193.2
5,945,226 A 8/1999 Harayama et al.
6,161,837 A 12/2000 Shureb
6,164,260 A * 12/2000 Bock ..... 123/193.2
6,213,474 B1 4/2001 Sameshima et al.
6,318,330 B1 11/2001 Kestner et al.
6,412,172 B1 7/2002 Kestner et al.
6,508,240 B1 1/2003 Bedwell et al.
6,553,957 B1 * 4/2003 Ishikawa et al. ..... 123/193.2
6,588,408 B2 * 7/2003 Bedwell et al. ..... 123/668
6,622,685 B2 * 9/2003 Takahashi et al. ..... 123/193.2
7,059,290 B2 6/2006 Ishikawa et al.
2002/0148430 A1 * 10/2002 Kano et al. ..... 123/193.2

FOREIGN PATENT DOCUMENTS

JP 355062157 A * 5/1980 ..... 277/441
JP 58027860 2/1983
JP 405306461 A * 11/1993

OTHER PUBLICATIONS

Hill, Stephen H. et al, An Experimental Study of the Effect of Cylinder Bore Finish on Engine Oil Consumption, SAE Technical Paper Series, pp. 247-255, Mar. 1995.

* cited by examiner

HIGH STRENGTH STEEL CYLINDER LINER FOR DIESEL ENGINE

This application claims priority to U.S. Provisional Patent Application Ser. No. 60/553,265, filed Mar. 15, 2004.

BACKGROUND OF THE INVENTION

1. Technical Field

This invention relates to cylinder liners for diesel engine applications.

2. Related Art

Historically, heavy duty diesel engines have employed replaceable cylinder liners made of various grades of cast iron. Cast iron is selected for its low production cost and good wear resistance due to the presence of free graphite at the running surface which acts as a lubricant. Increased wear resistance in the cylinder bore can be achieved by hardening the base cast iron alloy to create a martensitic microstructure.

For traditional cast iron liners, it has been demonstrated that under conditions of exhaust gas recirculation, or EGR, in which some of the exhaust gases are recirculated back into the cylinder for further combustion with the fresh fuel mix, the liners have shown accelerated wear in comparison to the same liners operating under non-EGR conditions. One contributing factor is that recirculated diesel exhaust contains abrasive particles and promotes the formation of various corrosive acids within the combustion chamber which are prone to attacking cast iron liners.

In addition to the wear considerations of cast iron liners, the requirement for ever-increasing emissions regulation has the effect of reducing the performance of the engines. This, coupled with the drive to yield ever-increased power from its engines, has caused diesel engine manufactures to increase the displacement of the cylinders in order to compensate for the power loss due to EGR. One solution is to thin the liners to increase the bore size while avoiding having to increase the size of the engine block. However, there is a limit as to how thin a cast iron liner can be made and still function properly. In particular, cast iron liners of thinner wall sections are prone to cavitation and distortion because the cast iron is a relatively porous material with free graphite present at the surface.

It is known to employ steel cylinder liners, but these are not know to be suitable designed for use in a heavy-duty wet linered diesel engine applications, where the temperatures are high and the peak cylinder pressures can reach 220 bar or more. These prior steel liners are known to be either of the dry liner variety (i.e., no water cooling) or of the air-cooled variety for aircraft usage.

SUMMARY OF THE INVENTION AND ADVANTAGES

Although the present invention has application outside of diesel engines having a certain amount of exhaust gas recirculated (EGR) back to the cylinder of the engine, it is particularly favorable in this environment for its resistance to the corrosive effects of an EGR environment. The present invention offers a solution to the limitations of cast iron liners in EGR applications, as well as offering high strength solutions for non-EGR engines as well, particularly connection with top and mid-stop liners by fabricating the liners out of steel rather than cast iron. Steel is considerably harder than cast iron and lacks the free graphite which is attributable in part to the undesirable wear and cavitation discussed above. Steels that can be used for the present invention include hardenable carbon and high chrome steels. The liners are manufactured with a texture roughness descriptor, TRD=5Rvk(100−Mr2) of between 50 and 400 μm. This texture can be applied over the entire inner running surface of the liner or to just an upper portion within 30-40 mm from the top of the liner in the in the region of the return stroke of the top piston ring. The liners are preferably thin-walled with a ratio of compound average liner section thickness to bore diameter in the range of 1.5 to 4 percent. This thin wall section allows for greater bore diameters in EGR engines, enabling engine manufacturers to gain additional cylinder displacement through use of relatively thin steel liners as favored over the traditional cast iron liners. Additionally, the inner wall of the liner is formed with a hardness that is within a spread of 10-20 Rc hardness of that of the piston rings.

The invention has the advantage of providing steel cylinder liners that are designed to operate in diesel engine applications. Steel liners are much less costly to produce than those of cast iron liners and can be made thinner so as to enable a larger cylinder displacement without having to increase the size of the engine block. Such thin, steel liners are capable of withstanding peak cylinder pressures of 220 bar and above without distortion, unlike their cast iron counterparts of comparable thickness. New engine platforms could be made smaller and lighter as the mass needed to ensure adequate support and strength of the steel liners would be less than that required for supporting conventional cast iron liners. Steel liners are less prone to breakage and are less prone to distortion as compared to traditional cast iron liners. Steel liners provide a good seal with the piston rings to enhance power and decrease emissions. Manufactures of such liners need not possess costly casting facilities needed for making cast iron liners and much of the machining equipment and processes presently used to finish cast iron liners can be used for the steel liners.

The invention further contemplates a diesel engine having such a steel liner, and original equipment or after-market power cylinder kits having such steel liners in combination with piston rings of compatible hardness.

THE DRAWINGS

Figure 2:
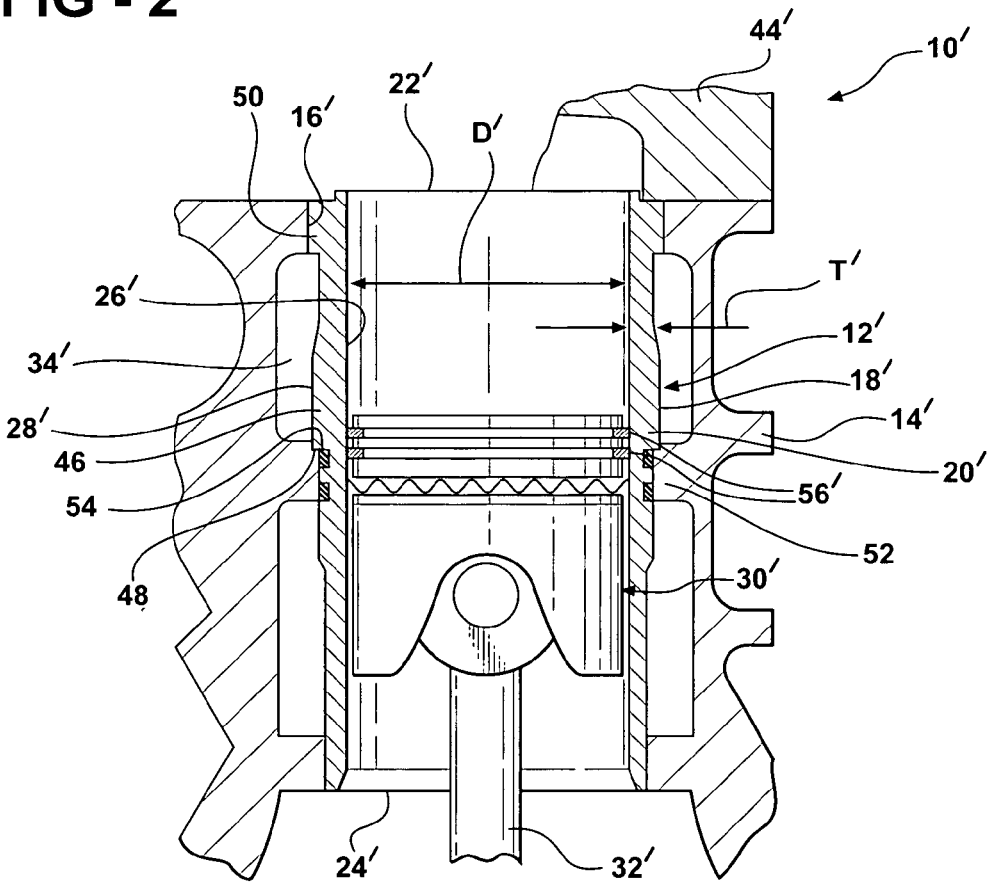

These and other features and advantages of the present invention will become more readily appreciated when considered in connection with the following detailed description and appended drawings, wherein:

FIG. 1 is a fragmentary sectional view of a diesel engine equipped with a top-stop liner according to the invention; and FIG. 2 is a fragmentary sectional view of a diesel engine equipped with a mid-stop liner according to the invention.

DETAILED DESCRIPTION

Turning now in more detail to the drawings, FIGS. 1 and 2 illustrate fragmentary cross-sectional views of a diesel engine 10, 10' fitted with top-stop and mid-stop liners 12, 12', respectively. The same reference numerals are used to designate like features of the embodiments of FIGS. 1 and 2, but those of FIG. 2 are primed.

The diesel engine 10, 10' includes an engine block 14, 14' formed with at least one piston bore 16, 16' in which the liner 12, 12' is removably mounted. The liners 12, 12' have a generally cylindrical body 18, 18' defined by a liner wall 20, 20' of predetermined thickness. The liner 12, 12' extends longitudinally between an upper or top end 22,22' and an opposite bottom end 24, 24' which are both open-ended. The wall 20, 20' presents in inner running surface 26, 26' and an outer surface 28, 28'. A piston 30, 30' is received in the liner 12,12' and is operatively coupled to a crank (not shown) of the engine 10, 10' by a connecting rod 32,32' for driving the piston 30 with up and down reciprocating motion within the liner 12,12' in known manner. The block 14, 14' is formed with a water jacket cavity or chamber 34, 34' that is in open communication with the piston bores 16, 16' but which is subsequently closed off from the piston bores 16, 16' upon installation of the liners 12,12' such that the outer surface 28, 28' of the liners 12,12' is in direct contact with cooling water contained in the water jacket 34, 34'. This "wet" cylinder liner construction provides proper cooling to the liners 12,12' during operation of the engine 10, 10'.

The top-stop liner 12 of FIG. 1 includes a top flange 36 formed at the top end 22 of the liner which extends radially0 outwardly of the outer surface 28 and presents a lower mounting shoulder or face 38. The engine block 14 is formed with a step or recess 40 surrounding the piston bore 16 and presenting an annular mounting face 42. The face 38 of the liner 12 is aligned with the face 42 of the block 14 and then is tightly clamped against the face 42 upon bolting a cylinder head 44 of the engine 10 to the block 14 in known manner. The region of the liner 12 below the top flange 36 hangs freely and is not under compression apart from that which may be needed to seal the lower region of the water jacket 34.

The liner 12' of FIG. 2 includes a mid-stop flange 46 formed at a generally mid location between the top and bottom ends 22', 24' of the liner 12' which extends radially outwardly of the outer surface 28' and presents a lower mounting shoulder or face 48. The liner 12' also may include a top flange 50 adjacent the top end 22' of the liner 22' and spaced from the mid-stop flange 46. The engine block 14' is formed with a mid-stop flange 52 surrounding the piston bore 16' and presenting an annular mounting face 54. The face 48 of the liner 12' is aligned with the face 54 of the block 14' and then is tightly clamped against the face 54 upon bolting the cylinder head 44' of the engine 10' to the block 14' in known manner. The region of the liner 12' above the mid-stop flange 52 is clamped under pressure, whereas the portion of the liner 12' below the mid-stop flange 54 hangs freely.

According to a particular aspect of the invention, a high strength, corrosion-resistant engine liner 12,12' of steel can be fabricated for particular use in wet-linered diesel engine applications including top and mid-stop liner applications having a texture roughness descriptor, TRD=5Rvk(100−Mr2) of between 50 and 400 μm. Such a steel liner 12,12' has the beneficial properties of holding a controlled volume of oil at the surface as compared to conventional liners which, in turn, contributes to a reduction in oil consumption of the engine. Too low of a TRD leads to accelerated wear (i.e., below 50 μm), whereas too high of a TRD leads to excessive oil consumption (i.e., above 400 μm). Such a liner 12,12' is particularly adaptable to the top and mid-stop liner applications that call for high strength in the vicinity of the flange, particularly in connection with the top flange liner, which is exposed to the heat of combustion at the top of the liner.

The steels suitable for use in the present invention are preferably those of the "H" designation, which covers hardenable grades of steel. One example is ANSI/SAE 4140 grade of steel, but the invention is not limited to this material. Preferred steels possess a K ratio of between 160 to 170 Gpa, where K is the ratio of Young's modulus to (1+Poisson's ratio) of the material.

The liner 12, 12' is thin-walled. The compound average liner section thickness T, T' of the wall 20,20' (excluding the thickness of the flanges) is set at about 1.5 to 4% of the measure of the bore diameter D, D' of the liner 12,12'. Such a liner is capable of withstanding peak cylinder pressures of 220 bar or more.

The liner 12,12' is formed with an inner surface 26, 26' hardness that is engineered to be within a spread of 10 to 20 Rc of the hardness of piston rings 56, 56' of the piston 30, and 30'.

In addition to the physical properties of the material, the steel liner 12,12' may be coated with various specialty coatings on all or a portion of the inner surface 26, 26' to enhance its abrasion/corrosion resistance and attack by EGR, including a chromium coating or plating, electroless nickel, and laser fused alloys to name a few. Those skilled will appreciate that any of a number of equivalent coatings could be employed in connection with the steel liner with the aim of improving corrosion and/or wear resistance.

Obviously, many modifications and variations of the present invention are possible in light of the above teachings. It is, therefore, to be understood that within the scope of the appended claims, the invention may be practiced otherwise than as specifically described.

What is claimed is:

1. A diesel engine comprising:

an engine block having at least one piston bore;

a cylinder head to be clamped to said block;

at least one cylinder liner removably disposed in said piston bore of said block and surrounded by a water jacket of said block in direct communication with an outer surface of said at least one liner; and wherein said cylinder liner is fabricated of a high strength, corrosion resistant grade of steel and wherein said cylinder liner has an inner surface with a texture roughness descriptor, TRD=5 Rvk(100−Mr2) of between 50 and 400 μm, and including at least one piston disposed in said at least one cylinder liner and including at least one piston ring in operational sliding contact with said inner surface of said at least one cylinder liner, said inner surface and said at least one piston ring having relative hardnesses in the range of 10-20 Rc of one another, and including a coating applied to said inner surface of said at least one cylinder liner, and wherein said at least one liner has a compound average liner section thickness set at about 1.5 to 4% of the bore diameter of said at least one cylinder liner.

2. The diesel engine of claim 1 wherein said steel comprises SAE 4140 grade of steel.

3. The diesel engine of claim 1 wherein said coating is chromium-based.

4. The diesel engine of claim 1 wherein said coating is nickel-based.

5. The diesel engine of claim 1 wherein said coating is a laser-fused coating.

6. The diesel engine of claim 1 wherein said at least one liner comprises a top-stop liner.

7. The diesel engine of claim 1 wherein said at least one cylinder liner comprises a mid-stop liner.

8. A piston, piston ring and liner assembly, comprising:

a cylinder liner fabricated of a high strength, corrosion resistant grade of steel for mounting in a block of a diesel engine, said cylinder liner having an inner surface surrounding a bore of said liner;

a piston and at least one piston ring carried on said piston, said piston and said at least one ring being positionable within said bore of said cylinder liner such that said at least one piston ring can be disposed in operating contact with said inner surface of said cylinder liner;

said inner surface of said cylinder liner having a surface finish defined by a texture roughness descriptor, TRD = 5Rvk(100−Mr2) of between 50 and 400 μm; and said inner surface of said cylinder liner and said at least one piston ring having relative hardnesses in the range of 10 to 20 Rc of one another, wherein said cylinder liner has a wall thickness that is between 1.5 and 4% of the bore diameter of said cylinder liner, and wherein said inner surface has a high temperature coating applied over top of said finished surface.

9. The assembly of claim 8 wherein said steel consists of 4140 grade of steel.

* * * * *